US006988389B2

(12) United States Patent
Hawkes

(10) Patent No.: US 6,988,389 B2
(45) Date of Patent: Jan. 24, 2006

(54) CONTINUOUS EXTRUSION APPARATUS

(75) Inventor: Daniel John Hawkes, Shadoxhurst (GB)

(73) Assignee: BWE Limited, Kent (GB)

( * ) Notice: Subject to any disclaimer, the term of this patent is extended or adjusted under 35 U.S.C. 154(b) by 0 days.

(21) Appl. No.: 11/200,192

(22) Filed: Aug. 10, 2005

(65) Prior Publication Data

US 2005/0268682 A1 Dec. 8, 2005

Related U.S. Application Data

(63) Continuation of application No. PCT/GB04/00701, filed on Feb. 20, 2004.

(30) Foreign Application Priority Data

Feb. 22, 2003 (GB) ..... 0304114

(51) Int. Cl.
*B21C 23/00* (2006.01)

(52) U.S. Cl. ..... 72/262; 72/342.8; 72/342.9

(58) Field of Classification Search ..... 72/253.1, 72/262, 342.1, 342.7, 342.8, 342.9, 364, 72/467, 707; 219/602, 635, 636, 637, 674
See application file for complete search history.

(56) References Cited

U.S. PATENT DOCUMENTS 5,133,126 A * 7/1992 Matsuoka ..... 29/527.4
5,147,085 A 9/1992 Hawkes et al.
5,152,163 A 10/1992 Hawkes et al.
5,157,955 A 10/1992 Hawkes et al.
5,167,138 A * 12/1992 Sinha et al. ..... 72/262
5,813,270 A 9/1998 Carter
5,836,191 A 11/1998 Wright
5,887,473 A 3/1999 Hawkes
5,935,476 A * 8/1999 Langstedt ..... 219/659
6,619,093 B2 9/2003 Dawson et al.
6,655,415 B2 12/2003 Dawson et al.

FOREIGN PATENT DOCUMENTS

| | | | |
|---|---|---|---|
| EP | 0 472 322 A2 | | 2/1992 |
| GB | 2 364 946 A | | 2/2002 |
| JP | 60-6220 | * | 1/1985 |
| JP | 62-289321 | * | 12/1987 |
| WO | 00/10750 A | | 3/2000 |
| WO | 01/64363 A1 | | 9/2001 |

OTHER PUBLICATIONS

International Search Report dated Jun. 4, 2004 in International Application No. PCT/GB2004/000701 filed Feb. 20, 2004 (3 pages).

* cited by examiner

*Primary Examiner*—Ed Tolan
(74) *Attorney, Agent, or Firm*—Shlesinger, Arkwright & Garvey LLP

(57) ABSTRACT

Die heater body assembly for continuous extrusion apparatus includes a die block of non-magnetic material for the extrusion of copper tube and a bucket portion forming a sliding fit in a die heater body. The die heater body includes a coil of copper tubing in a ceramic support material provided with electric power and cooling water connections to heat the bucket portion by electrical induction to a temperature of approximately 700° Celsius. To concentrate the electric induction heating effect at the bucket portion low reluctance magnetic members and magnetic material end blocks direct eddy current flow toward the bucket portion. Weakening of the shoe as a consequence of provided the heating is limited.

11 Claims, 1 Drawing Sheet

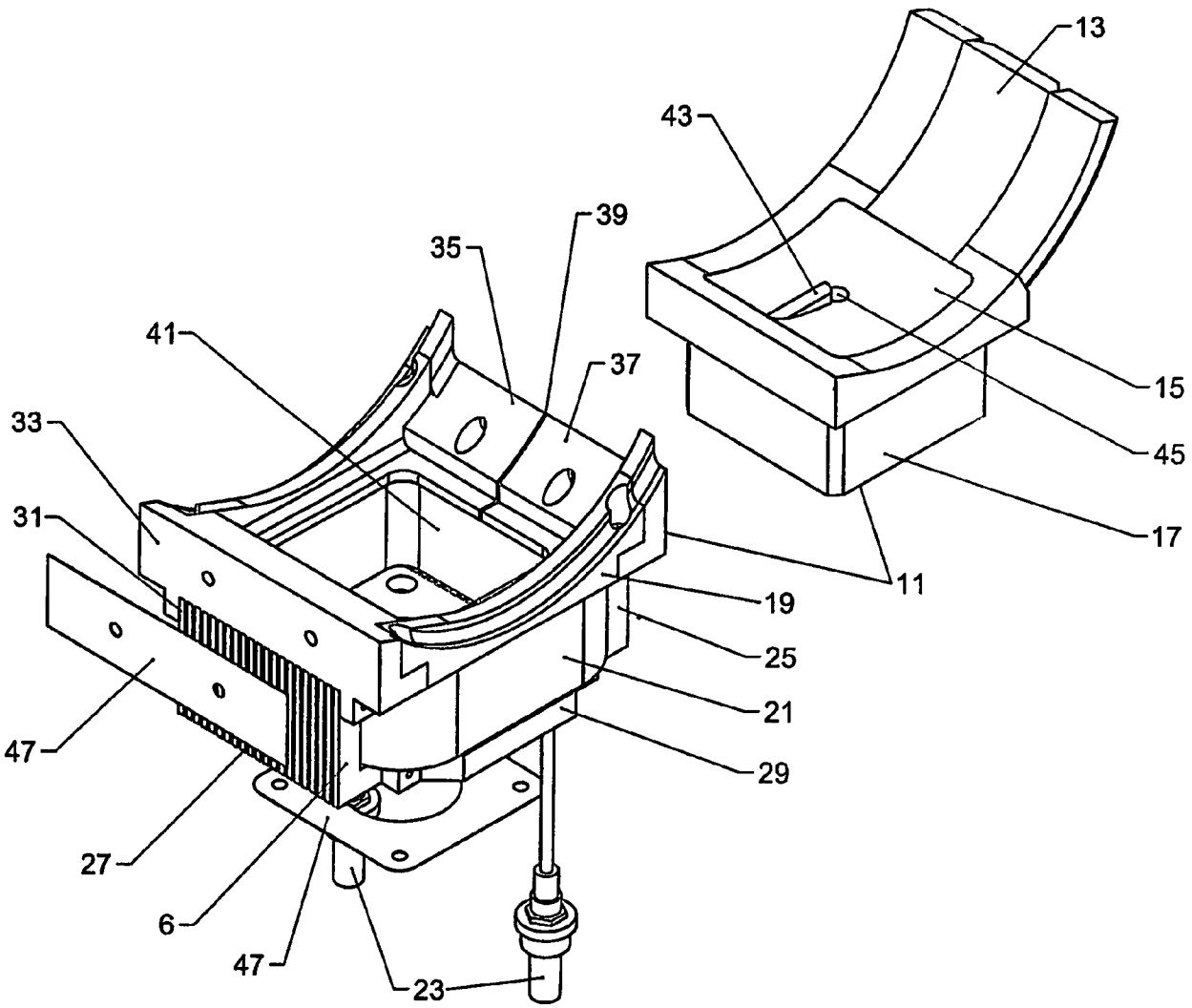
13
15
45
17
11
43
19
25
21
29
39
37
35
23
41
47
6
33
31
27
47

CONTINUOUS EXTRUSION APPARATUS

CROSS-REFERENCE TO RELATED APPLICATIONS

This application is a continuation of application no. PCT/GB04/00701, filed Feb. 20, 2004, which claims priority of United Kingdom application no. 0304114.2, filed Feb. 22, 2003, and each of which is incorporated herein by reference.

FIELD OF THE INVENTION

This invention relates to apparatus for the forming of metals by a continuous extrusion process in which feedstock is introduced into a circumferential groove in a rotating wheel to pass into a passageway formed between the groove and arcuate tooling extending into the groove.

BACKGROUND OF THE INVENTION

EP-A-071 490 discloses continuous extrusion apparatus having a rotatable wheel formed with a circumferential groove, a shoe including arcuate tooling bounding a radially outer portion of the groove provided with an exit aperture in a die body and an abutment displaced in the direction of rotation from the exit aperture.

OBJECTS AND SUMMARY OF THE INVENTION

According to the present invention, the shoe or shoe element is provided with a die block heater body assembly accommodating a die heater body. an extrusion die or die element and an electrical induction heating coil assembly arranged to be energizeable to co-act with a magnetizable element associated with the die or die element to effect electrical induction heating thereof.

Preferably, a magnetic member is positioned externally of the electrical induction heating coil assembly and is adapted to limit magnetic leakage outwardly of the electrical induction heating coil assembly.

Desirably, thermal insulation material is positioned intermediate the magnetic member and the shoe.

Suitably, the electrical induction heating coil assembly includes a helically wound copper tube encased in electrical insulating material and provided both with electrical connections and inlet and outlet connections for a flow of coolant.

BRIEF DESCRIPTION OF THE DRAWINGS

The sole FIGURE is a partially exploded perspective view of the continuous extrusion apparatus according to the invention.

DETAILED DESCRIPTION OF THE INVENTION

The invention will now be described, by way of example, with reference, in part, to the general arrangement of continuous extrusion apparatus described in relation to FIGS. 1 and 2 of EP-A-071 490; and, in the main, to the accompanying, partly diagrammatic, isometric, exploded view of a die heater body assembly 11 arranged to be positioned in a rectangular cross-section aperture in a shoe (not shown, but similar to that shown as the shoe 8 in EP-A-071 490) for the extrusion of copper tube.

The die heater body assembly 11 includes an entry block 13, a die block 15, a centrally apertured bucket portion 17 and a die heater body 19.

The die heater body 19 includes a helical coil of copper tubing set in ceramic support material to form an electrical induction heating coil assembly 21 provided with electric power and cooling water connections 23 extending rearwardly through the shoe. Low reluctance magnetic members 25 are positioned outwardly of the electrical induction heating coil assembly 21 and typically are formed of six millimeter thick stampings 27 of "Silicon-Iron" alloy having a high saturation magnetism and a Curie point in excess of 800° Celsius, spaced apart to form three millimeter gaps, mounted on a centrally apertured base plate 29. End portions 31 of the stampings 27 are connected to first and second magnetic material end blocks 33 and 35 and 37, the second end blocks 35 and 37 being separated by gap 39 to restrict eddy current circulation. A corresponding gap is formed in the base plate 29.

The entry block 13 is formed with the die block 15 of non-magnetic material co-acting with the bucket portion 17 of magnetic material co-acting, in turn, as a sliding fit, with a pocket 41 in the die heater body 19. Dowels (not shown) locate the end blocks 33, 35 and 37 on the shoe whilst allowing differential thermal expansion. An abutment 43 is positioned on the die block 15 at a location displaced in the direction of rotation from a port 45 leading to a central aperture arranged to receive an extrusion die (not shown), located in the bucket portion 17 of the die block 15.

Thin shims 47 of heat insulating material, such as mica, are positioned intermediate the end block 33, 35 and 37, base plate 29 and the shoe to limit heat transmission to the shoe.

In operation, with the entry block 13, the die block 15 and the bucket portion 17 positioned in the die heater body 19 to form the die heater body assembly 11 and positioned in the shoe of the continuous extrusion apparatus and with copper feedstock being urged to the entry block 13 and die, the bucket portion 17 is inductively heated to a temperature of approximately 700° Celsius by passing an electrical current at a power level of approximately twelve kilowatts and frequency of approximately 50 Hertz through the electrical induction heating coil assembly 21 to maintain the die, by conduction, at a temperature of 700° Celsius, thereby greatly facilitating the extrusion process through the die. By positioning the electrical induction heating coil assembly 21 adjacent the die block 15 and directing eddy current flow through the bucket portion 17 by the effect of the low reluctance magnetic members 25, magnetic leakage to the carbon steel material of the shoe and adjoining steelwork is restricted and a high proportion of the input energy is transferred to the die block 15 and the resulting heat energy conducted to the copper feed material without causing elevated temperatures in the shoe and substantially affecting the ability of the shoe to withstand radial ladings of approximately 300 tonnes generated to achieve the requisite extrusion pressures of approximately 500 Megapascals at the die. Inductively heating the die block 26 avoids substantial heating of adjoining parts of the continuous extrusion apparatus and thereby avoids consequential reduction in mechanical properties of the constituent materials arising from elevated temperatures.

It will be appreciated that whilst the foregoing description relates to a radial extrusion configuration of the continuous extrusion machine, the invention is also applicable to a machine utilizing a tangential extrusion configuration with the gap 39 between the second end blocks 35 and 37 together with the associated stampings 27 being dimensioned to accommodate the tangential configuration.

In addition, it will be appreciated that the configuration and construction of the die heater body 19 is such as to produce a very compact arrangement operating at normal electrical supply frequency. The compact arrangement requires only a minimum aperture in the shoe, thereby keeping to a minimum weakening of the shoe as a result of providing the aperture. Utilizing normal electrical supply frequency avoids any need to provide electrical circuitry adapted to increase the frequency and the consequential cost thereof.

It will also be appreciated that whilst the foregoing description relates to the extrusion of copper material, the invention is also applicable to the extrusion of other materials. For materials such as aluminum, where a die chamber of magnetic material is utilized, the bucket portion 17 may be omitted so that a larger die block being directly inductively heated may be utilized.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Continuous extrusion apparatus, comprising:

a) a rotatable wheel;

b) a circumferential groove provided on the rotatable wheel;

c) a shoe;

d) the shoe including arcuate tooling bounding a radially outer portion of the circumferential groove provided with an exit aperture in a die body, and an abutment displaced in the direction of rotation from the exit aperture; and e) the shoe being provided with a die heater body assembly accommodating a die heater body, an extrusion die, and an electrical induction heating coil assembly arranged to be energizeable to co-act with a magnetizeable element associated with the extrusion die to effect electrical heating thereof.

2. Continuous extrusion apparatus as claimed in claim 1, wherein:

a) a magnetic member is positioned externally of the electrical induction heating coil assembly and is configured to limit magnetic leakage outwardly of the electrical induction heating coil assembly.

3. Continuous extrusion apparatus as claimed in claim 2, wherein:

a) the magnetic member includes spaced plates of a low reluctance and high saturation magnetic material having a Curie point in excess of 800° Celsius extending parallel to a radial plane of the rotatable wheel.

4. Continuous extrusion apparatus as claimed in claim 3, wherein:

a) thermal insulation material is positioned intermediate the magnetic member and the shoe.

5. Continuous extrusion apparatus as claimed in claim 2, wherein:

a) thermal insulation material is positioned intermediate the magnetic member and the shoe.

6. Continuous extrusion apparatus as claimed in claim 5, wherein:

a) the electrical induction heating coil assembly includes a helically wound copper tube encased in electrical insulating material and provided both with electrical connections and inlet and outlet connections for a flow of coolant.

7. Continuous extrusion apparatus as claimed in claim 1, wherein:

a) the electrical induction heating coil assembly includes a helically wound copper tube encased in electrical insulating material and provided both with electrical connections and inlet and outlet connections for a flow of coolant.

8. Continuous extrusion apparatus as in claim 7, wherein:

a) the electrical induction heating coil assembly is energizeable at a frequency of approximately 50 Hertz with an electrical energy input of approximately 12 kilowatts to effect heating of the extrusion die to a temperature of approximately 700° Celsius.

9. Continuous extrusion apparatus as in claim 1, wherein:

a) the electrical induction heating coil assembly is energizeable at a frequency of approximately 50 Hertz with an electrical energy input of approximately 12 kilowatts to effect heating of the extrusion die to a temperature of approximately 700° Celsius.

10. Continuous extrusion apparatus as claimed in claim 9, wherein:

a) the die includes a die of non-magnetic material positioned in a bucket portion of magnetic material arranged to conduct heat electrically induced in the material of the bucket portion by the electrical induction heating coil assembly to the die.

11. Continuous extrusion apparatus as claimed in claim 1, wherein:

a) the die includes a die of non-magnetic material positioned in a bucket portion of magnetic material arranged to conduct heat electrically induced in the material of the bucket portion by the electrical induction heating coil assembly to the die.

* * * * *